US005811669A

United States Patent [19]

Polonyi

[11] Patent Number: 5,811,669

[45] **Date of Patent: *Sep. 22, 1998**

[54] CYCLING COMPRESSOR PERFORMANCE METERING

[75] Inventor: Michael J. G. Polonyi, New York, N.Y.

[73] Assignee: Rodolfo Esteban Polonyi, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 802,735

[22] Filed: Feb. 20, 1997

[51] Int. Cl.[6] ..... G01L 3/26; G01L 5/13

[52] U.S. Cl. ..... 73/116; 417/8; 73/112

[58] Field of Search ..... 417/5, 6, 8, 53, 417/63; 73/865.8, 865.9, 116, 112

[56] References Cited

U.S. PATENT DOCUMENTS

| | | | |
|---|---|---|---|
| 3,665,399 | 5/1972 | Zehr et al. | 340/413 |
| 4,502,842 | 3/1985 | Currier et al. | 417/8 |
| 4,990,057 | 2/1991 | Rollins | 417/12 |
| 5,639,224 | 6/1997 | Schlossarczyk et al. | 417/298 |

*Primary Examiner*—George M. Dombroske
*Assistant Examiner*—Max H. Noori

[57] ABSTRACT

A computational sequence that allows a stand-alone instrument or a central data processing unit to calculate flow of compressed ideal gases based on measurements of pressure and time only, in systems where compressors start and stop at regular intervals and based on the system's pressure.

2 Claims, 3 Drawing Sheets

CYCLING COMPRESSOR PERFORMANCE METERING

BACKGROUND

1. Field of Invention

This invention relates to a method to measure flow of ideal compressed gases in and out of closed systems, driven by compressors starting and stopping at regular intervals, through pressure and time-measurements.

2. Description of Prior Art

Heretofore there was no practical way to monitor the efficiency of cycling compressed air installations. Given the nature of the process, it was not possible to determine what the real compressed air usage was.

Originally, I developed a way to determine compressor production and compressed gases load by hand, without having to take the equipment out of service. The method requires only a stopwatch and a pressure gauge.

This principle was published by me in Chemical Engineering, Dec. 9/23, 1985, p. 132, under the title "Operating Performance of Reciprocating or Positive Displacement Compressors," and quoted again in my book "Power and Process Control Systems", McGraw-Hill Book Co., 1991, Page 37.

These publications did not reveal the detailed workings as described in this application, but only the principles involved. Practical implementation of this principle was not realized until 1996, when a stand-alone device, capable of conducting the described functions, was finally possible.

This original device was offered for sale to Fair-Rite Corporation in Springfield, Vt., on May 31, 1996, and was in service there.

OBJECTS AND ADVANTAGES

Accordingly, several objects and advantages of this invention are:

- Non-invasive flow metering of ideal compressed gases in installations driven by cycling compressors
- Measures both compressed gases flowing in and flowing out of a closed system volume.
- Tracks wear and tear of cycling compressors by measuring gradual changes in compressor output.
- Tracks average compressed air consumption of equipment and alerts for possible leaks.
- Continuously supervises on-line cycling compressed gases installations.
- Eliminates the uncertainty about compressed gases installations, as far as gas production and consumption rates is concerned.

Still further objects and advantages will become apparent from a consideration of the ensuing description and accompanying drawings.

Reference Numerals

10 Step 1, Start—Initialize Registers

Figure 1:
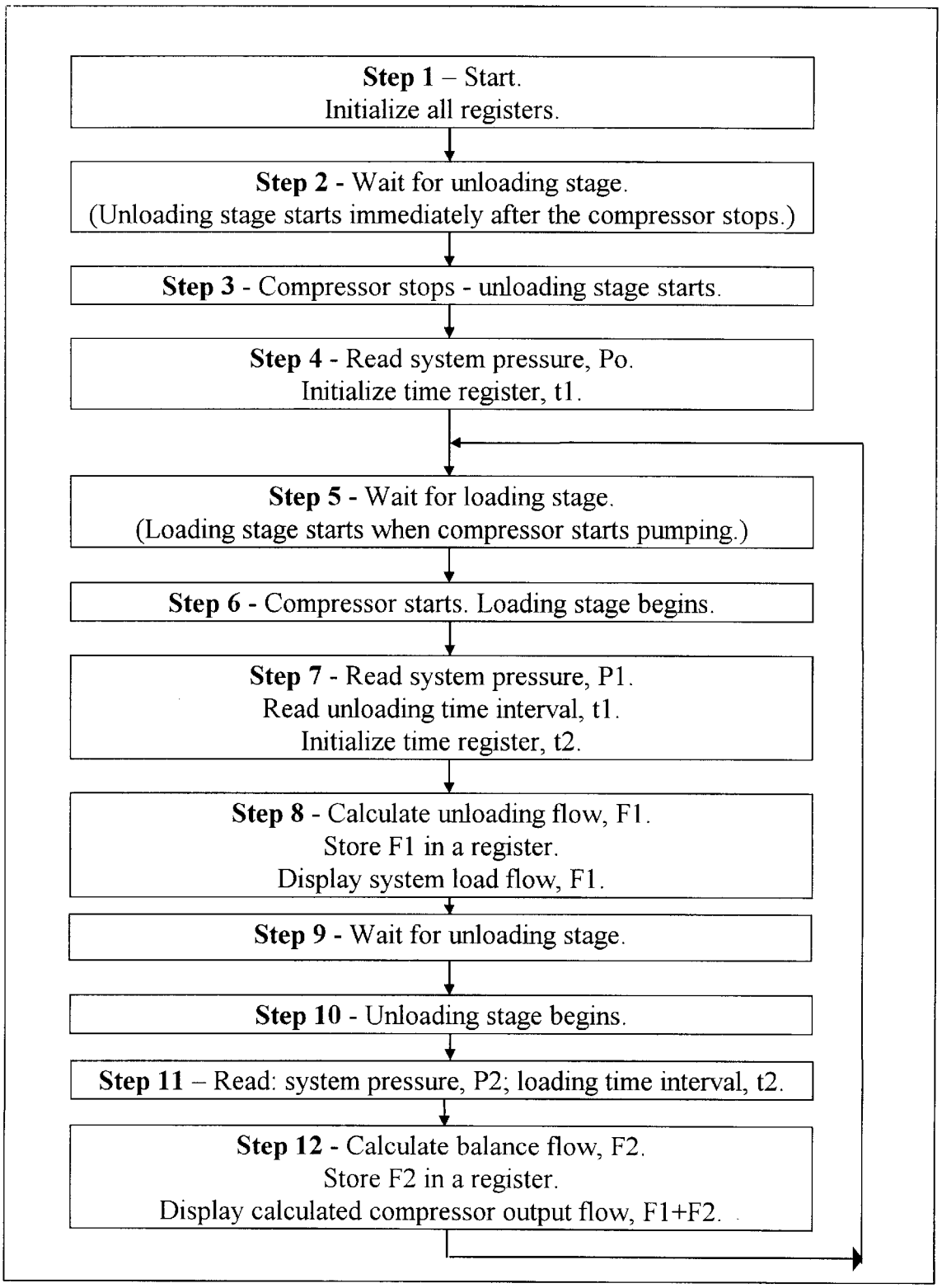
FIG. 1 shows a computational sequence, a.k.a. flow chart, in which the process variables measurement and flow calculations take place.
Figure 2:
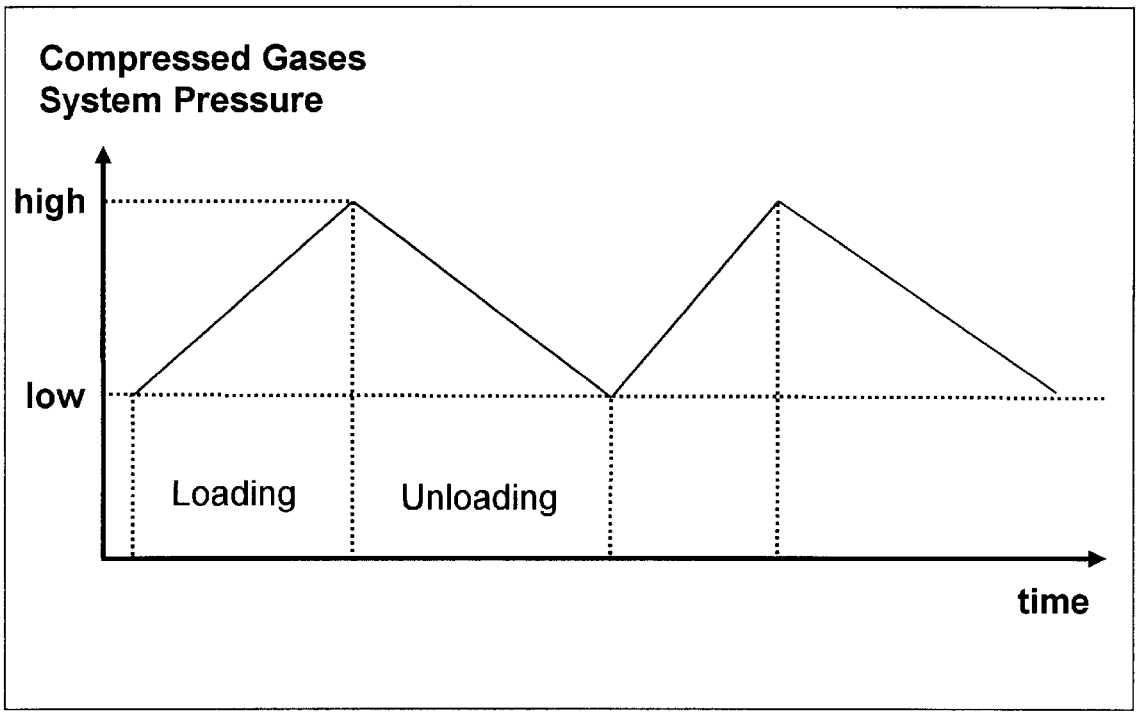
FIG. 2 shows how the pressure changes over time in a system controlled by the pressure of an ideal gas and by the starting or stopping of compressors. It is referred to as "System Pressure Cycle."

12 Step 2, Wait for unloading stage

14 Step 3, Compressor stops—unloading stage starts

16 Step 4, Read system pressure, Po. Set time register to zero

18 Step 5, Wait for loading stage (Loading stage starts when compressor starts pumping)

20 Step 6, Compressor starts—Loading stage starts

22 Step 7, Read system pressure, P1, Read time t1

24 Step 8, Calculate flow F1. Store F1 in a register. Display load flow, F1

26 Step 9, Wait for unloading stage

28 Step 10, Unloading stage begins

30 Step 11 Read system pressure, P2, and time interval t2

32 Step 12, Calculate flow F2. Store F2 in a Register. Display compressor output flow, F1+F2

34 A general purpose data processor of known type, able of:

36 (a) performing additions, substractions, multiplication and division;

38 (b) accepting analog type signal input from a pressure transducer;

40 (c) accepting digital type inputs from compressor start/stop operation contacts

42 (d) measuring time lapses

44 (e) storing calculations, constants and states in a memory area

46 (f) displaying and conveying results

48 a) accepting and processing signals (1) from a pressure transducer and (2) from optional start and stop signals of compressor operation.

50 b) a clock, to measure elapsed time between pressure readings.

52 c) executing a sequence of calculations.

54 d) storing data, as needed to provide repeatable physical data.

56 e) a display to show the results.

58 a cycling compressor performance meter is a computational sequence

SUMMARY

A method to continuously supervise compressed air installations of the cycling type.

PREFERRED EMBODIMENT—DESCRIPTION

FIG. 1—Computation Sequence (Software)

A cycling compressor performance meter is a computational sequence 58, FIG.1, executed by a data processor of known type, that allows supervision of a compressed ideal gas system while in service. Through the signal of a system pressure transducer and compressor start and stop signals, are all the necessary external variables provided.

Step 1, Start—Initialize Registers 10, is the first step required when turning a data processor on.

Step 2, Wait for the unloading stage 12, indicates that the sequence should wait until the pressure starts dropping, this normally occurs when the compressors stop. This step is necessary in order to calculate the system load first.

Step 3, Compressor stops—unloading stage starts 14, indicates that a signal confirming this event.

Step 4, Read system pressure, Po. Set time register to zero 16, indicates that the measurement of the pressure rate-of-change commences.

Step 5, Wait for loading stage (Loading stage starts when compressor starts pumping) 18, indicates the interval that comprehends the measurements of step 4.

Step 6. Compressor starts—Loading stage starts 20, indicates that a signal was received confirming this event.

Step 7. Read system pressure, P1, Read time t1 22, records the elapsed time and new pressure.

Step 8. Calculate unloading flow F1. Store F1 in a register. Display load flow, F1 24, indicates that the system load can now be calculated and displayed.

Step 9, Wait for unloading stage 26, indicates the time interval while the compressor is engaged.

Step 10. Unloading stage begins 28, reflects that a signal was received confirming this event.

Step 11 Read system pressure, P2, and loading time interval t2 30, records the elapsed time and new pressure.

Step 12, Calculate flow F2. Store F2 in a Register. Display compressor output flow, F1+F2 32, indicates that the compressor production can now be calculated and displayed.

In short, the gas pressure relative rate-of-change will be clocked at regular intervals and multiplied by the system volume. This calculation provides the resultant amount of air entering or leaving the system, depending if the pressure is increasing or decreasing, respectively.

Figure 3:
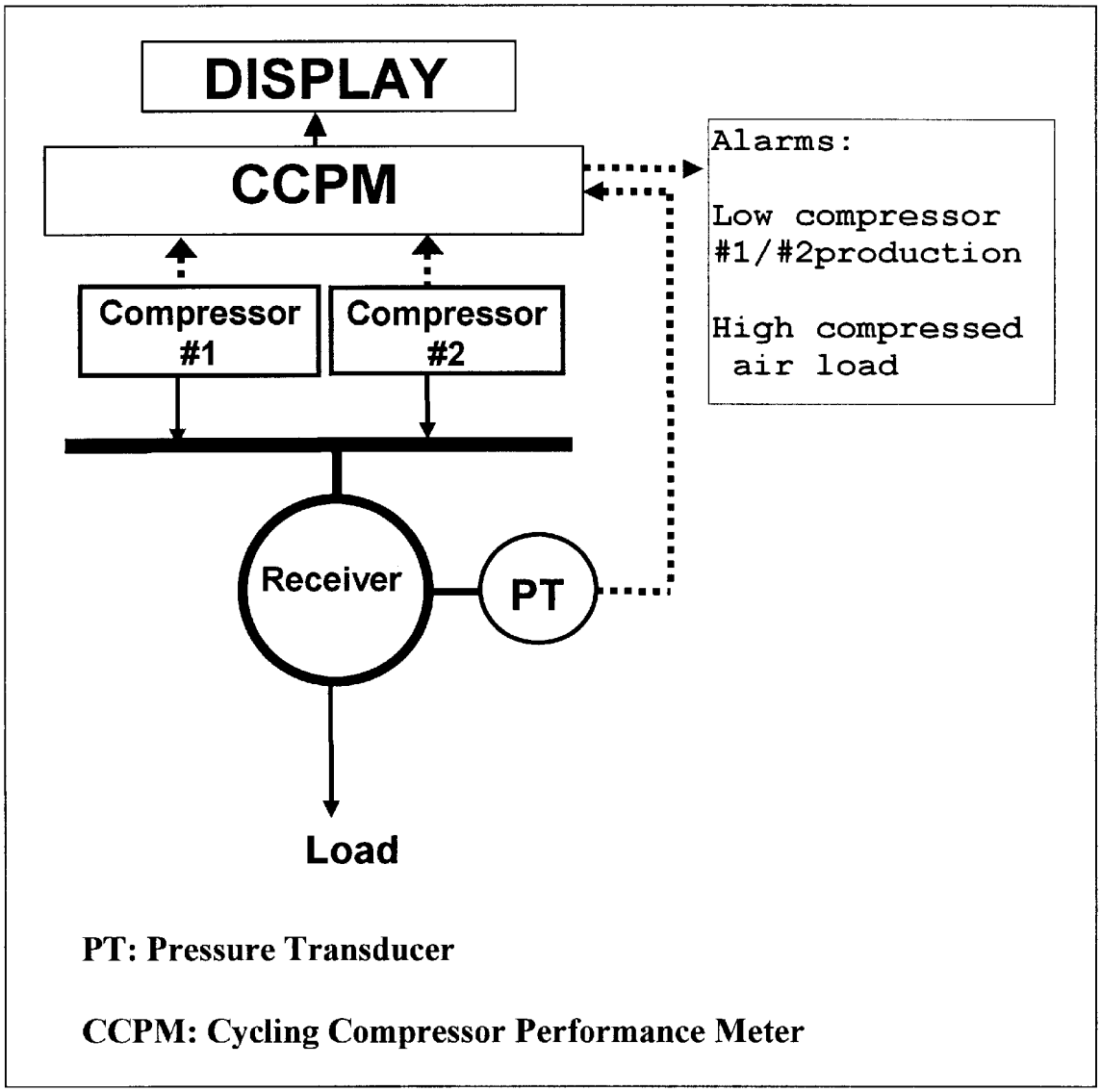
FIG. 3 shows a typical compressed-air system installation diagram, with two compressors, major piping, a compressed gas tank also referred to as "receiver", a pressure transducer PT, a general purpose data processor of known type referred to as CCPM, a display and an optional alarm interface.

FIG. 3—Typical elements (Hardware)

A typical Cycling Compressor Performance Meter will consist of the following elements:

A general purpose data processor of known type, able of 34: (a)performing additions, sub tractions, multiplication and division 36; (b) accepting analog type signal input from a pressure transducer 38; (c) accepting digital type inputs from compressor start/stop operation contacts 40; (d) measuring time lapses 42; (e) storing calculations, constants and states in a memory area 44; (f) displaying and conveying results 46.

PREFERRED EMBODIMENT—OPERATION (FIG. 2)

Measuring the pressure drop while the compressors are off, allows to calculate the amount of air leaving the system during the measurement interval. It is therefore necessary to calculate first the amount of gas leaving the system. This can only be done while all the compressors are off.

Once a compressor starts pumping, the pressure rate-of-change will be proportional to the balance of the amount of gas entering and leaving a closed system. For a gas behaving as a perfect or ideal gas, at constant temperature:

$$\text{pressure} \times \text{volume} = \text{constant, or, } p1/p2 = v2/v1$$

therefore, the flow will be established by:

$$\text{Flow} = \frac{\text{SystemVolume} \times \text{PressureChange}}{\text{PressureReference} \times \text{TimeInterval}}$$

See FIG. 3. Once the compressor starts, if the compressor output exceeds the amount of gas escaping the system, the pressure will increase. While the compressor is pumping and the pressure is increasing, the pressure rate of change is measured and the excess amount of air is calculated.

By adding the calculated excess amount of air pumped into the previously calculated amount of air leaving the system, the amount of air pumped by the compressors can be calculated, provided the load remained constant during the whole cycle.

Additional parameters, such as, compressor efficiency, load factor, load change, can then be calculated.

Therefore, by applying the previous equation the measurements in question are realized. The following equations show how this is done for each case. To calculate the system load flow or compressed gases load flow:

$$\text{System Load Flow} = \frac{\text{SystemVolume} \times \text{PressureChange(while compressor is off)}}{\text{PressureReferenceValue} \times \text{TimeInterval(while compressor off)}}$$

To calculate a gas compressor output flow:

$$\text{Compressor Output Flow} = \frac{\text{SystemVolume} \times \text{PressureChange(while compressor is on)}}{\text{PressureReference} \times \text{TimeInterval(while compressor is on)}} + \text{SystemLoad}$$

Compressor output flow is also the actual compressor pumping capacity.

To calculate compressor efficiency, defined as the ratio between two output flows, one when the compressor is new and one when the compressor is in service:

$$\text{Compressor Efficiency} = \frac{\text{actual compressor output flow}}{\text{new compressor output flow}}$$

Compressor wear defined as the inverse of compressor efficiency.

To calculate load factor, defined as the ratio between two previously calculated flows, actual compressor output flow and actual gas consumption load flow:

$$\text{Load factor} = \frac{\text{actual gas consumption load flow}}{\text{actual compressor output flow}}$$

To calculate load change, defined as the ratio between two calculated load flows, the actual consumption load flow and a design load flow referred to as system reference flow.

$$\text{Load change} = \frac{\text{actual gas consumption load flow}}{\text{system reference load flow}}$$

Unaccounted loads and load changes are referred to as system leaks.

System pressure refers to the pressure at which the gas is subjected in a closed volume also referred to as "the system".

Other Embodiments

Stand-alone CCPM—Description

As a stand-alone unit, a cycling compressor performance meter consists of a digital electronic device capable of:

a) accepting and processing signals (1) from a pressure transducer and (2) from optional start and stop signals of compressor operation.48 b) a clock, to measure elapsed time between pressure readings. 50 c) executing a sequence of calculations. 52 d) storing data, as needed to provide repeatable physical data. 54 e) a display to show the results. 56

Stand-alone CCPM—Operation

A stand-alone Cycling Compressor Performance Meter will operate as shown on FIG. 1

CCPM as part of a system control center—Description

Cycling Compressor Performance Metering lends itself readily to be absorbed as part of centralized or distributed control systems, as found in major industrial plants, power, chemical and commercial Heating Ventilating and Air Conditioning plants.

The required pressure signal and optional compressor start and stop signals may already be in the system. In this case, only the necessary program sequence, algorithms and displays must be added.

CCPM as part of a system control center—Operation

The Cycling Compressor Performance Metering operation as part of a system control center will be as shown on FIG.1

Conclusions, Ramifications, and Scope

Accordingly, it can be seen that Cycling Compressor Performance Metering can adopt many embodiments, e.g., as stand alone digital electronic instruments with a suitable display, or connected to and part of a major control system.

Although the previous examples contain specificities, these should not be construed as limiting the scope of the invention but as merely providing illustrations of some of the presently preferred embodiments of this invention. Various other embodiments and ramifications are possible within it's scope.

Thus the scope of the invention should be determined by the appended claims and their legal equivalents, rather than by the examples given.

What is claimed is:

1. A method for calculating the following:

a) total compressed gases load flow b) gas compressor output flow c) compressor efficiency d) compressor wear e) load factor f) load change g) system leaks on a closed and pressurized system running compressors, while operating a general purpose data processor capable of: keeping track of elapsed time intervals, storing in registers reference and calculated values, inputing the said system gas pressure as a variable signal input, executing the mathematical operations of: addition, subtraction, multiplication and division; while executing the following steps:

I) measuring the compressed gases pressure drop rate of change, while all compressors are off line, and hereby calculating the total compressed gases load flow(a)

II) measuring the compressed gases pressure increase rate of change while one or more compressors are on line and thereby calculating the balance of gases entering and leaving the closed system III) calculating the total compressor output flow(b), by adding total compressed gases load flow (I) and the balance of gases entering and leaving the closed system (II)

IV) calculating compressor efficiency(c), by ratioing total compressor output(III) to the compressor original factory output V) calculating compressor wear(d), by calculating the inverse of compressor efficiency (c)

VI) calculating load factor(e), by ratioing total compressed gases load flow (I) to total compressor output flow (III)

VII) calculating load change(f), by ratioing total compressed gases load flow (I) to a system reference load value VII) calculating system leaks(g), by subtracting all accounted system loads from total compressed gases load flow (I).

2. A data processing device of known type capable of executing the process sequence and formulae on a closed pressurized system running compressors and inputing the said system gas pressure as a variable signal input, comprising of the following steps:

I) means for measuring the gases pressure drop rate of change, while all compressors are off line to calculate total compressed gases load flow II) means for measuring the gases pressure increase rate of change while one or more compressors are on line to calculate the balance of compressed gases flow entering and leaving the system III) means for adding the amount of total compressed gases load flow (I) and the balance of compressed gases entering and leaving the system (II) in order to calculate compressor output flow IV) means for comparing compressor output flow (III) to the compressors original output in order to calculate compressor efficiency V) means for finding the inverse of compressor efficiency(IV) in order to calculate compressor wear VI) means for comparing total compressed gases load flow(I) to compressor output flow(III) in order to calculated the load factor VII) means for comparing total compressed gases load flow(I) to a reference system load value in order to calculate load change VII) means for subtracting all accounted system loads from total compressed gases load flow(I) in order to calculate system leaks.

* * * * *